US011242873B2

(12) United States Patent
Moodie

(10) Patent No.: US 11,242,873 B2
(45) Date of Patent: Feb. 8, 2022

(54) PNEUMATIC OR HYDRAULIC MECHANISM

(71) Applicant: S-GUN LIMITED, Wellington (NZ)

(72) Inventor: David John Moodie, Wellington (NZ)

( * ) Notice: Subject to any disclaimer, the term of this patent is extended or adjusted under 35 U.S.C. 154(b) by 0 days.

(21) Appl. No.: 16/341,332

(22) PCT Filed: Oct. 11, 2017

(86) PCT No.: PCT/NZ2017/050130
§ 371 (c)(1),
(2) Date: Apr. 11, 2019

(87) PCT Pub. No.: WO2018/070881
PCT Pub. Date: Apr. 19, 2018

(65) Prior Publication Data

US 2019/0271337 A1 Sep. 5, 2019

(30) Foreign Application Priority Data

Oct. 11, 2016 (NZ) ..... 725032

(51) Int. Cl.
*B25C 1/04* (2006.01)
*F15B 15/14* (2006.01)
(Continued)

(52) U.S. Cl.
CPC ..... *F15B 15/1476* (2013.01); *B25C 1/041* (2013.01); *F15B 15/1452* (2013.01);
(Continued)

(58) Field of Classification Search
CPC .. F15B 15/204; F15B 15/1476; F15B 15/224; F15B 15/225; F15B 15/226; B25C 1/041;
(Continued)

(56) References Cited

U.S. PATENT DOCUMENTS 2,914,368 A 11/1959 Farmer et al.
3,026,849 A * 3/1962 Powers ..... B25C 1/041 91/461

(Continued)

*Primary Examiner* — Thomas E Lazo
*Assistant Examiner* — Michael Quandt
(74) *Attorney, Agent, or Firm* — Stoel Rives LLP

(57) ABSTRACT

A pneumatic or hydraulic mechanism has a housing defining a piston chamber and having a fluid inlet port. A piston is slidable in the piston chamber. The piston partitions the piston chamber into a front chamber and a rear chamber. The piston has one or more passages for fluid communication between the rear chamber and the front chamber, the one or more passages being sealed by a sealing mechanism. The sealing mechanism has a sealing state in which the sealing mechanism substantially inhibits fluid communication between the rear chamber and the front chamber, and a non-sealing state in which the sealing mechanism allows fluid communication between the rear chamber and the front chamber. The piston is slidable between a first position and a second position. When the piston is positioned in the first position, the sealing mechanism is in the sealing state. Upon supply of a fluid to the inlet port, the fluid urges the piston to its second position and then causes the sealing mechanism to change to the non-sealing state until the pressure in the rear chamber and the front chamber equalises, allowing the sealing mechanism to return to the sealing state. Upon removal of fluid from the rear chamber, the fluid in the front chamber urges the piston to return to its first position.

8 Claims, 7 Drawing Sheets

(51) Int. Cl.
*F15B 15/20* (2006.01)
*F15B 15/22* (2006.01)

(52) U.S. Cl.
CPC ..... *F15B 15/204* (2013.01); *F15B 15/225* (2013.01); *B25C 1/047* (2013.01)

(58) Field of Classification Search
CPC B25C 1/04; B25C 1/042; B25C 1/043; B25C 1/047; B25C 1/048
USPC ..... 91/416, 422, 399, 401, 417 A; 227/130; 92/85 B, 85 R
See application file for complete search history.

(56) References Cited

U.S. PATENT DOCUMENTS

| | | | | |
|---|---|---|---|---|
| 3,160,075 | A * | 12/1964 | Powers | B25C 1/041 91/402 |
| 3,229,589 | A | 1/1966 | Langas | |
| 3,638,534 | A | 2/1972 | Ramspeck | |
| 3,651,740 | A * | 3/1972 | Perkins | B25C 1/041 91/417 A |
| 3,815,475 | A | 6/1974 | Howard et al. | |
| 3,880,051 | A | 4/1975 | Eppler | |
| 2005/0156383 | A1 | 6/2005 | Zitting et al. | |
| 2015/0061230 | A1 | 6/2015 | Mina | |

* cited by examiner

PNEUMATIC OR HYDRAULIC MECHANISM

RELATED APPLICATIONS

This application is a National Stage of International Application No. PCT/NZ2017/050130, filed Oct. 11, 2017, which claims priority of New Zealand Provisional Patent Application No. 725032, filed Oct. 11, 2016.

TECHNICAL FIELD

This invention relates to a pneumatic or hydraulic mechanism.

BACKGROUND INFORMATION

Single acting pneumatic cylinders work by having pressure fluid work in only one direction, that is, behind the piston to force the piston forwards within the cylinder. To return the piston, a single acting cylinder has either a mechanical spring that pushes the piston back to its starting position, or, a fluid spring, where the piston is returned to its starting position by a buildup of compressed fluid in front of the piston. This has definite disadvantages, such as the piston losing force on its forward stroke due to fighting the force of either the mechanical spring or the compressed fluid spring. Another disadvantage is the return spring takes up room at the end of the cylinder, therefore increasing the overall length of the cylinder. A further disadvantage is that it is not practical to manufacture long stroke or large bore single acting cylinders due to the size and cost of the springs needed.

A double acting pneumatic cylinder overcomes the problem that a single acting cylinder has, by dispensing with either the mechanical return spring, or, the fluid compression spring and instead uses pressure fluid for the piston retraction stroke. This is done by having two pressure fluid inlet ports, one behind the piston and one in front of the piston. The advantage of this is that the piston is not fighting the force of the return spring on its forward stroke so therefore maintains full force for the entire forward stroke. One of the disadvantages that a double acting cylinder has is that it requires a full cylinder chamber of compressed air to complete the retraction stroke. Therefore, the double acting pneumatic cylinder is using twice the amount of air that a single acting cylinder uses. In addition, double acting cylinders generally receive compressed fluid to return the piston through tubes located on the outer sides of the cylinder wall. This increases the overall dimensions of the pneumatic mechanism.

Using twice the volume of compressed air has disadvantages in itself for the double acting cylinder. It means that the compressor that is compressing the air in a pneumatic type cylinder, is having to generate twice as much compressed air for the piston to complete a full cycle. This then means that the compressor is using twice as much electricity or fuel as it would for the single acting cylinder. Using twice the volume of air also has consequences for the operator in that the compressor's air tank is having to refill twice as much as it would for a single acting cylinder and this will generally mean that the operator will suffer down time waiting for the air tank to refill.

However, it's generally perceived that the double acting cylinder's disadvantages still outweigh the single acting cylinder's advantages, due to the fact that the piston faces zero resistance on its forward stroke, therefore offering more power than the single acting cylinder.

Further, many pneumatic mechanisms, such as nail guns, have complex valve arrangements to return the piston to its starting position that are difficult to access and maintain and manufacture.

It is an object of at least some embodiments of the present disclosure to address at least one of the abovementioned disadvantages and/or to at least provide the public with a useful alternative.

In this specification where reference has been made to patent specifications, other external documents, or other sources of information, this is generally for the purpose of providing a context for discussing the features of the disclosure. Unless specifically stated otherwise, reference to such external documents or such sources of information is not to be construed as an admission that such documents or such sources of information, in any jurisdiction, are prior art or form part of the common general knowledge in the art.

SUMMARY OF THE DISCLOSURE

In accordance with a first aspect of the disclosure, there is provided a pneumatic or hydraulic mechanism comprising:

- a housing defining a piston chamber and having a fluid inlet port and an exhaust port;
- a piston slidable in the piston chamber, the piston partitioning the piston chamber into a front chamber and a rear chamber, the piston having one or more passages for fluid communication between the rear chamber and the front chamber, the one or more passages being sealed by a sealing mechanism;
- the sealing mechanism having a sealing state in which the sealing mechanism substantially inhibits fluid communication between the rear chamber and the front chamber, and a non-sealing state in which the sealing mechanism allows fluid communication between the rear chamber and the front chamber;
- a movable bumpstop that is movable to seal the exhaust port;
- the piston being slidable between a first position and a second position;
- wherein, when the piston is positioned in the first position, the sealing mechanism is in the sealing state, and fluid in front of the piston is exhausted from the exhaust port, past the movable bumpstop;
- upon supply of a fluid to the inlet port, the fluid urges the piston to its second position at which the piston forces the bumpstop to seal the exhaust port, and the supply of the fluid then causes the sealing mechanism to change to the non-sealing state until the pressure in the rear chamber and the front chamber equalises, allowing the sealing mechanism to return to the sealing state;
- upon removal of fluid from the rear chamber, the fluid in the front chamber urges the piston to return to its first position.

In one embodiment, the piston chamber has a first portion having a first diameter corresponding to the first position of the piston and a second portion having a second diameter corresponding to the second position of the piston, the second diameter being larger than the first diameter.

In one embodiment, the sealing mechanism comprises a sealing member.

In one embodiment, the sealing member is an expandable sealing member that is arranged to expand to be in the sealing state.

In one embodiment, the piston chamber has a first portion having a first diameter corresponding to the first position of the piston and a second portion having a second diameter corresponding to the second position of the piston, the second diameter being larger than the first diameter.

In one embodiment, the piston chamber has a first portion corresponding to the first position of the piston and a second portion corresponding to the second position of the piston, the second portion having a plurality of channels.

In one embodiment, the one or more passageways comprises one or more bores.

In one embodiment, the expandable sealing member is an annular member.

In one embodiment, the mechanism further comprises one or more additional seals between the piston and the piston chamber.

In one embodiment, the mechanism further comprises one or more exhaust ports.

In one embodiment, the mechanism further comprises a piston rod.

The term 'comprising' as used in this specification and claims means 'consisting at least in part of'. When interpreting statements in this specification and claims which include the term 'comprising', other features besides the features prefaced by this term in each statement can also be present. Related terms such as 'comprise' and 'comprised' are to be interpreted in a similar manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

To those skilled in the art to which the disclosure relates, many changes in construction and widely differing embodiments and applications of the disclosure will suggest themselves without departing from the scope of the invention as defined in the appended claims. The disclosures and the descriptions herein are purely illustrative and are not intended to be in any sense limiting. Where specific integers are mentioned herein which have known equivalents in the art to which this disclosure relates, such known equivalents are deemed to be incorporated herein as if individually set forth.

As used herein the term '(s)' following a noun means the plural and/or singular form of that noun.

As used herein the term 'and/or' means candy or 'or', or where the context allows both.

The disclosure consists in the foregoing and also envisages constructions of which the following gives examples only.

BRIEF DESCRIPTION OF THE DRAWINGS

The present disclosure will now be described by way of example only and with reference to the accompanying drawings in which.

DETAILED DESCRIPTION OF EMBODIMENTS

Figure 1:
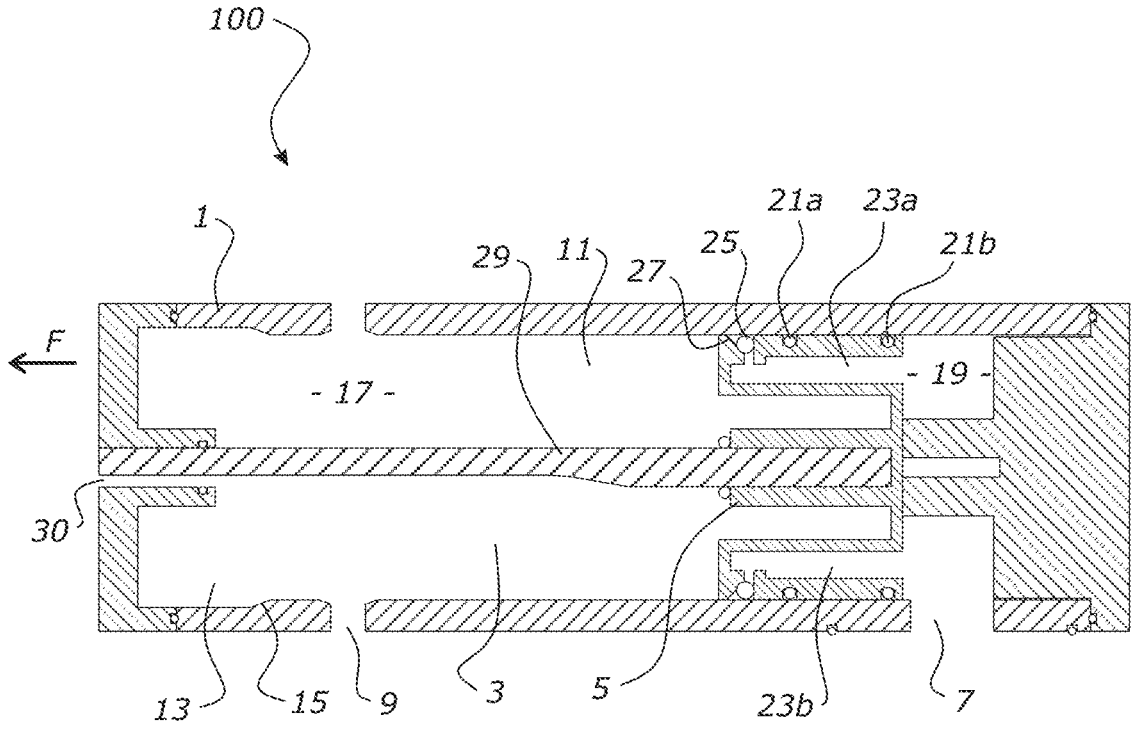
FIG. 1 is a section view of a pneumatic mechanism according to an exemplary embodiment of the present disclosure, showing the mechanism in a starting position.

With reference to FIGS. 1 to 8, an embodiment of the pneumatic or hydraulic mechanism 100 will now be described. The embodiment may be a nail gun mechanism. However, it will be appreciated that the mechanism may be other mechanisms, such as vehicle braking system, a paintball gun, or air-powered weapons. For convenience, an arrow marked 'F' has been inserted into some of the figures to indicate a forward direction of the nail gun mechanism. Accordingly the terms forward, rearward, left side, and right side (or similar) should be construed with reference to the forward direction F. These terms are used for ease of explanation and are not intended to be limiting.

The mechanism 100 has a housing 1 defining a piston chamber 3 and a piston 5. The piston chamber and piston preferably have a cylindrical shape. The housing 1 has a fluid inlet port 7 and one or more exhaust ports 9. The inlet port 7 may also function as one of the exhaust ports.

The piston chamber 3 has a first portion 11 having a first diameter corresponding to the first position of the piston 5 and a second portion 13 having a second diameter corresponding to the second position of the piston 5. As shown in FIG. 1, the second diameter is larger than the first diameter. The transition 15 between the first and second diameter is tapered. The piston chamber 3 also has a groove containing the one or more exhaust ports 9. The first portion 11 of the piston chamber 3 is of sufficient size to hold a certain quantity of pressurized fluid. The area at the front of the cylinder is preferably stepped, but it may have other shapes.

Figure 3:
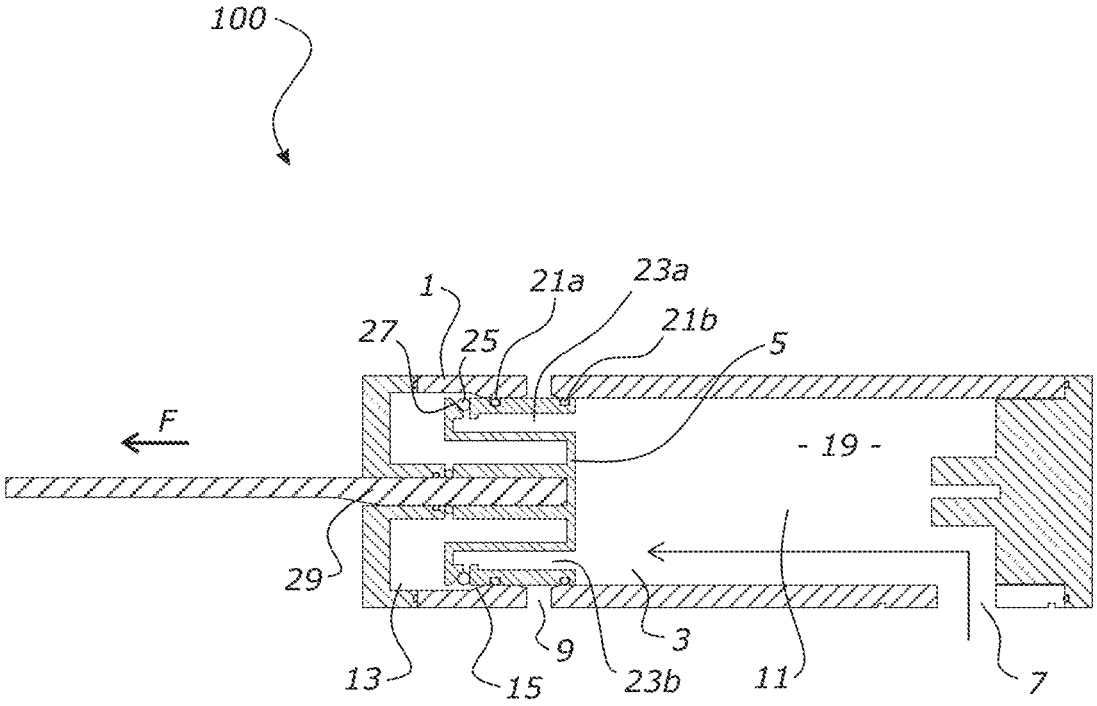
FIG. 3 is a section view of the mechanism of FIGS. 1 and 2, showing the mechanism in a third condition with the plunger in its second position with the expandable sealing member in an unexpanded state.

The piston 5 is slidable in the piston chamber 3. The piston 5 partitions the piston chamber 3 into a front chamber 17 and a rear chamber 19. The piston is slidable in the piston chamber 3 between a first position (FIG. 1) and a second position (FIG. 3).

The piston 5 has annular seals 21*a*, 21*b* around its outer surface to seal against the interior surface of the piston chamber 3. The seals 21*a*, 21*b* substantially prevent fluid flow between the front chamber 17 that is in communication with the exhaust port 9 and the rear chamber 19 that is in communication with the inlet 7. In the embodiment shown, the seals 21*a*, 21*b* are O-ring type rubber seals, but the seals may comprise any other suitable seal.

The piston 5 has one or more passages for fluid communication between the rear chamber 19 and the front chamber 17. In the embodiment shown, the passages are bores 23*a*, 23*b* in the piston.

The bores 23*a*, 23*b* are sealed by a sealing mechanism. The sealing mechanism has a sealing state in which the sealing mechanism substantially inhibits fluid communication between the rear chamber 19 and the front chamber 17, and a non-sealing state in which the sealing mechanism allows fluid communication between the rear chamber 19 and the front chamber 17. In the embodiments of FIGS. 1 to 8, the sealing mechanism comprises an expandable sealing member 25. In the sealing state, the expandable sealing member 25 is not expanded. In the non-sealing state, the expandable sealing member 25 is expanded. The differences and movement between the states is described in more detail below.

The expandable sealing member 25 is an annular member. In the embodiment shown, the expandable sealing member 25 sits in a forward angled groove 27 within the piston 5. The expandable sealing member 25 is an O-ring that acts as a check valve or one-way valve to provide the sealing state and the non-sealing state. When the piston 5 is positioned in the first position, the expandable sealing member 25 is in the sealing state and substantially inhibits fluid communication between the rear chamber 19 and the front chamber 17.

The mechanism 100 further comprises a piston rod 29. The rod 29 is shaped with a relatively narrower diameter and a relatively wider diameter.

Upon supply of a fluid to the inlet port 7, the fluid urges the piston 5 to its second position. The fluid then causes the expandable sealing member 25 to expand to permit fluid communication from the rear chamber to supply fluid to the front chamber (non-sealing state). The fluid is supplied through the bores 23*a*, 23*b* until the pressure in the rear chamber 19 and the front chamber 17 equalizes. The equalized pressure allows the expandable sealing member 25 to return to a non-expanded state (sealing state).

Figure 7:
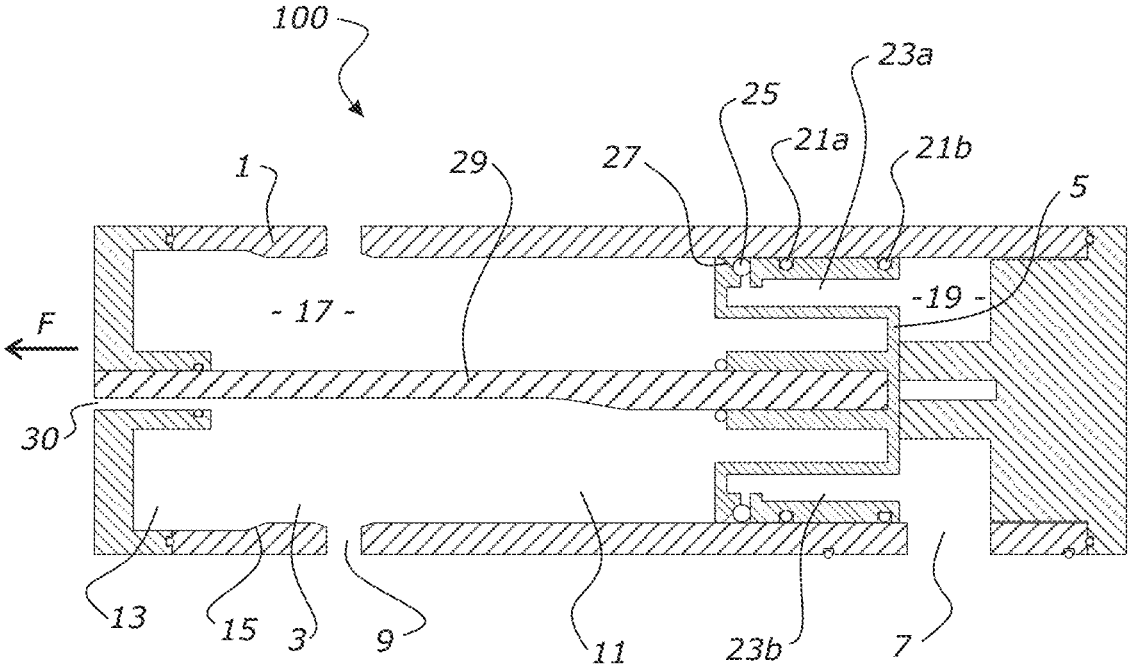
FIG. 7 is a section view of the mechanism of FIGS. 1 to 6, showing the mechanism returned to the position of FIG. 1.

Upon removal of fluid from the rear chamber 19 through the inlet/exhaust port 7, the fluid in the front chamber 17 urges the piston to return to its first position (FIG. 7).

Figure 2:
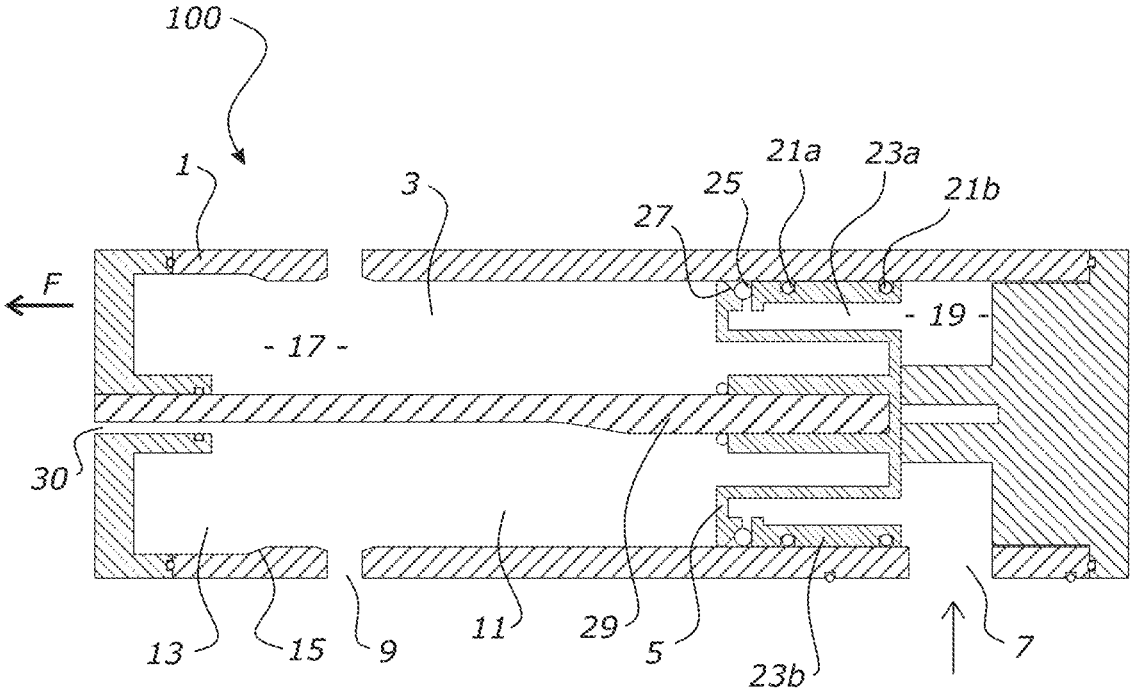
FIG. 2 is a section view of the mechanism of FIG. 1, showing the mechanism in a second condition with pressurised fluid supplied to the rear chamber and the plunger unmoved.

The mechanism 100 starts in the condition shown in FIG. 1. When a trigger member (not shown) is activated, pressure fluid is released into the rear chamber 19 through the inlet port 7 behind the piston 5 (FIG. 2). Upon supply of a fluid to the inlet port 7, the fluid urges the piston 5 to its second position (FIG. 3).

When the piston 5 reaches the second position within the first portion of the piston chamber 3 at the front of the cylinder, only the expandable sealing member 25 is positioned within the first portion of the piston chamber. In this position, the other annular seals 21*a*, 21*b* sealingly engage with each side of the exit port 9, or, ports behind the first portion of the piston chamber 3, preventing any exiting of pressure fluid.

Figure 4:
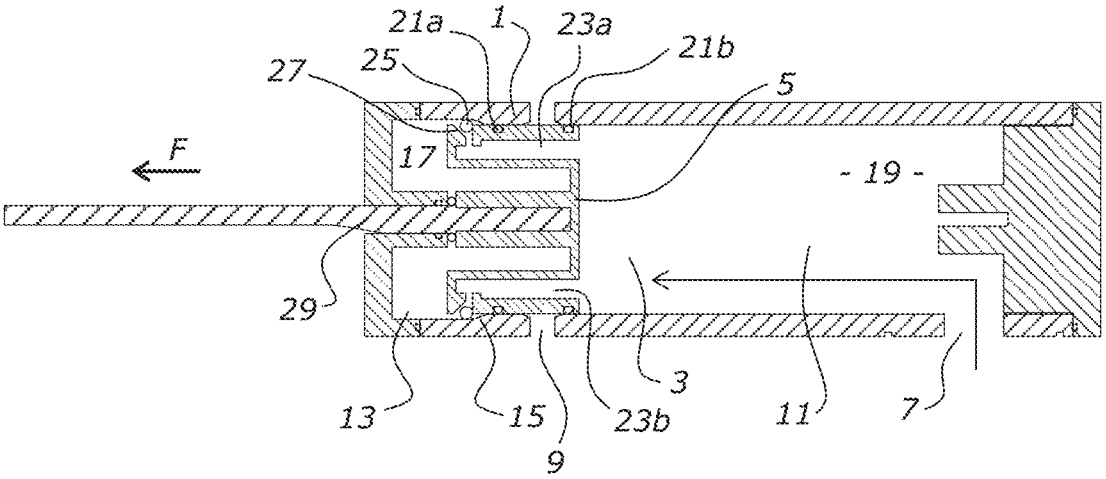
FIG. 4 is a section view of the mechanism of FIGS. 1 to 3, showing the mechanism in a fourth condition with the plunger in its second position with the expandable sealing member in an expanded state.

With reference to FIG. 4, the fluid then causes the expandable sealing member 25 to expand to permit fluid communication from the rear chamber 19 to supply fluid to the front chamber 17 (non-sealing state). In particular, the expandable sealing member 25 expands and lifts out of the groove 27 in the piston 5, but is prevented from completely lifting out by the cylinder chamber step. The expandable sealing member 25 is no longer sealingly engaged with the main cylinder chamber at this point. It will be understood that the expandable sealing member 25 will be attempting to expand before it lifts out of the groove 27, but is prevented from doing so by the walls of the cylinder.

The expandable sealing member 25 remains expanded or open allowing pressure fluid to flow through the bore, or, plurality of bores 23*a*, 23*b* until the pressure in the rear chamber 19 and the front chamber 17 equalizes.

Figure 5:
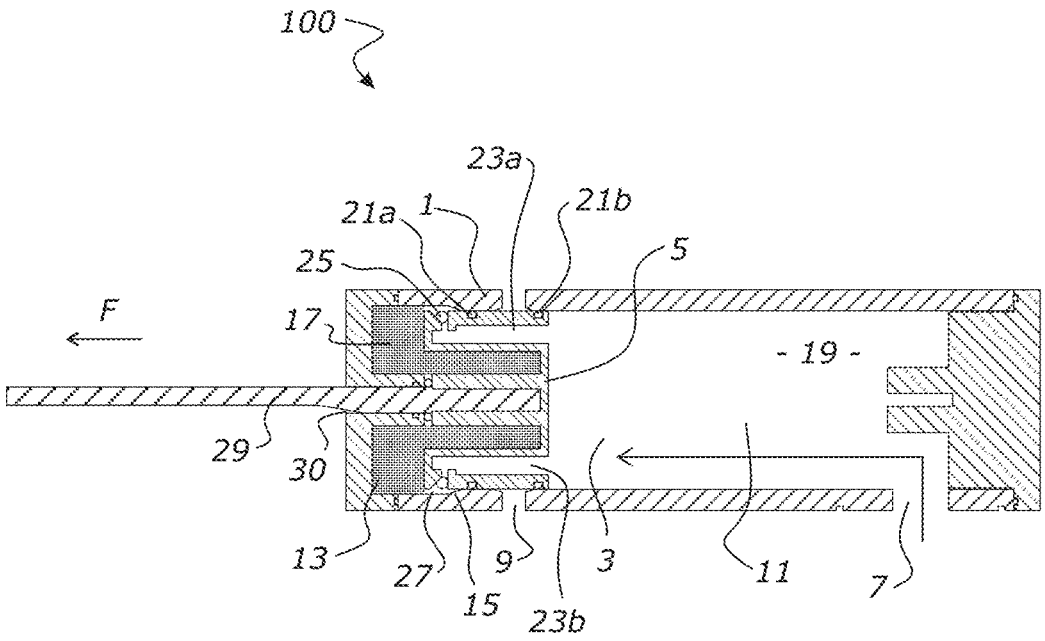
FIG. 5 is a view corresponding to FIG. 4, showing the mechanism in a fifth condition with the expandable sealing member returned to the unexpanded state with the pressurised fluid being expelled from the rear chamber.
Figure 6:
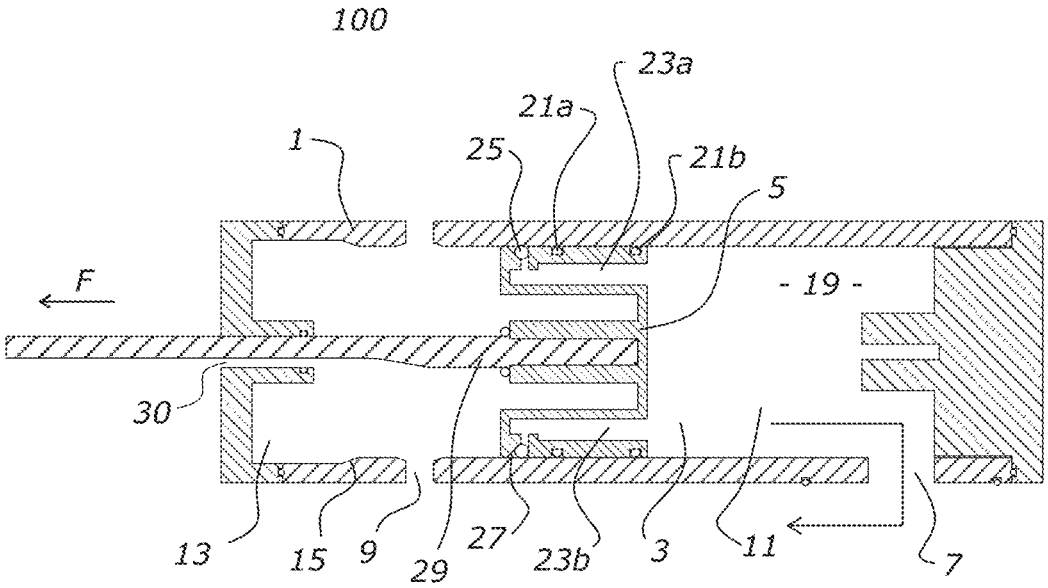
FIG. 6 is a section view of the mechanism of FIGS. 1 to 5, showing the mechanism in a sixth condition with the pressurised fluid being expelled from the rear chamber and the pressurised fluid in the front chamber causing the plunger to return to the first position.

Once equal pressure is attained on both sides of the piston 5, pressure fluid is no longer forcing the expandable sealing member 25 to be open or expanded. As a result, the expandable sealing member 25 returns to its non-expanded state (FIG. 5).

Pressure fluid remains sealed in the front chamber 17 and cannot pass to the rear chamber 19 because the bores are blocked by the expandable sealing member 25. With the release of the trigger, a fluid exit port behind the piston 5 is opened causing pressure fluid to escape through the exit port behind the piston 5 and fluid is removed from the rear chamber. In the embodiment shown, the inlet port 7 operates as the exit port. It will be appreciated that the mechanism may comprise one or more alternative exit ports. That causes a pressure imbalance. Upon removal of fluid from the rear chamber 19, the fluid in the front chamber 17 urges the piston 5 to return to its first position (FIG. 7). The piston 5 accelerates or moves to that position under its own momentum.

Figure 8:
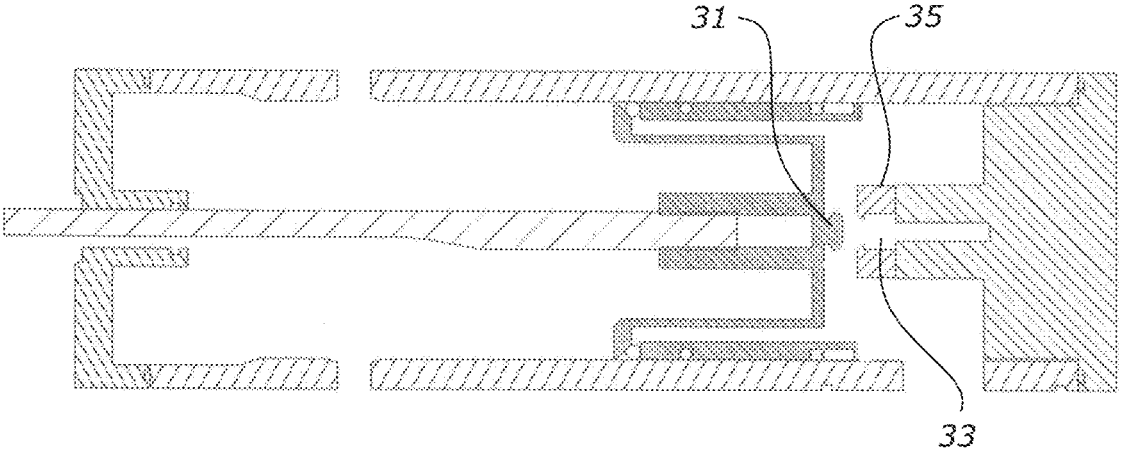
FIG. 8 shows details of a mechanism for securing the mechanism in the position of FIG. 1.

After the piston 5 returns to its starting position, it is locked or secured into position by a mechanical device attached to the end of the cylinder and the piston. With reference to FIG. 8, the mechanical device may be a protrusion 31 that is received by a complementary aperture 33 formed in a boss 35. Either one or both of the protrusion 31 or boss 35 may be formed from an elastomeric material, such as polyurethane. As the piston 5 returns to its starting position, the exit ports 9 are now free to exhaust pressure fluid from the front chamber 17.

With reference to FIGS. 9 to 13, another embodiment of the pneumatic or hydraulic mechanism 1100 will now be described. This embodiment is similar to the embodiment shown and described in relation to FIGS. 1 to 8, unless described below. Like numbers are used to indicate like parts, with the addition of 1000.

The mechanism 1100 has a housing 1001 defining a piston chamber 1003 and a piston 1005. The housing 1001 has a fluid inlet port 1007 and one or more exhaust ports 1009. The inlet port 1007 may also function as one of the exhaust ports.

The exhaust ports are located at the front of the housing 1001. The exhaust ports are closed by a movable bump stop 1039. The bump stop 1039 is connected to the housing 1001 by a resiliently flexible web 1041. The flexible web 1041 suitably contains one or more apertures to allow air to flow through the web 1041. In alternative embodiments, the bump stop 1039 may be connected to the housing with other resilient components or arrangements, such as a spring.

Figure 13:
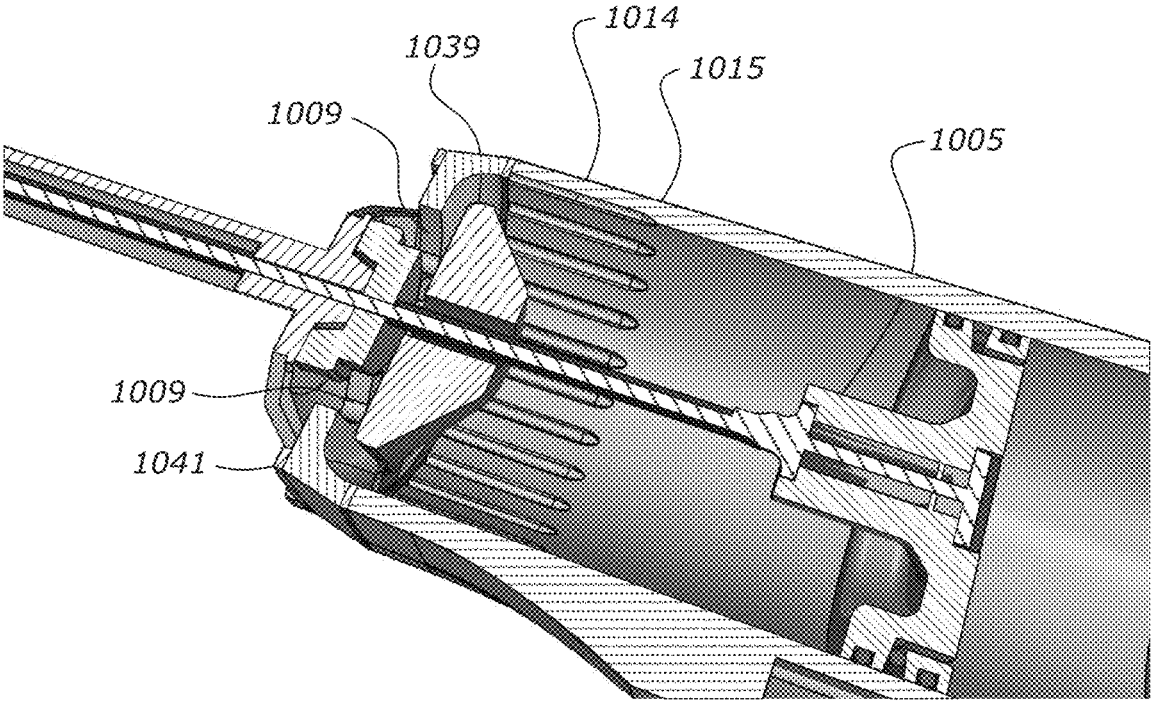
FIG. 13 is a cutaway view of the mechanism of FIG. 9.

The piston chamber 1003 has a first portion 1011 corresponding to the first position of the piston 1005 and a second portion 1013 corresponding to the second position of the piston 1005. As shown in FIG. 13, the second portion 1013 is formed by a plurality of channels 1014. The transition 1015 between the first portion 1011 and the channels 1014 is tapered.

The channels 1014 are evenly spaced about the piston chamber 1003. The channels 1014 are all of the same length. In alternative embodiments, the channels may be unevenly spaced and/or have different lengths.

In this embodiment, the sealing mechanism comprises an expandable sealing member 1025. The sealing mechanism also has annular seals 1021*a*, 1021*b* around the outer surface of the piston 1005 to seal against the interior surface of the piston chamber 1003. The seals 1021*a*, 1021*b* are positioned on either side of the expandable sealing member 1025. The seals 1021*a*, 1021*b* substantially prevent fluid flow between the front chamber 1017 that is in communication with the exhaust port 1009 and the rear chamber 1019 that is in communication with the inlet 1007. In the embodiment shown, the seals 1021*a*, 1021*b* are O-ring type rubber seals, but the seals may comprise any other suitable seal.

Figure 9:
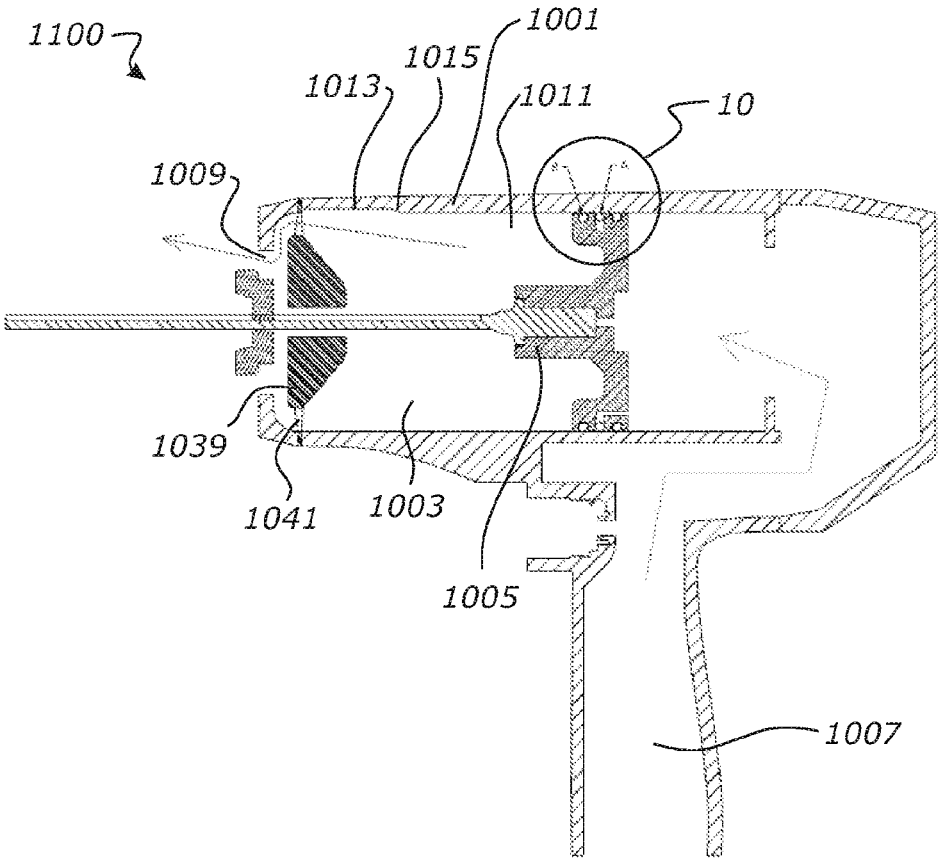
FIG. 9 is a section view of a pneumatic mechanism according to another exemplary embodiment of the present disclosure, showing the mechanism in a starting position.

FIG. 9 shows supply of pressurised fluid to the inlet port 1007, which urges the piston 1005 to move towards its second position. The fluid in front of the piston is exhausted from the exhaust port(s) 1009, past the sliding bumpstop 1039.

Figure 10:
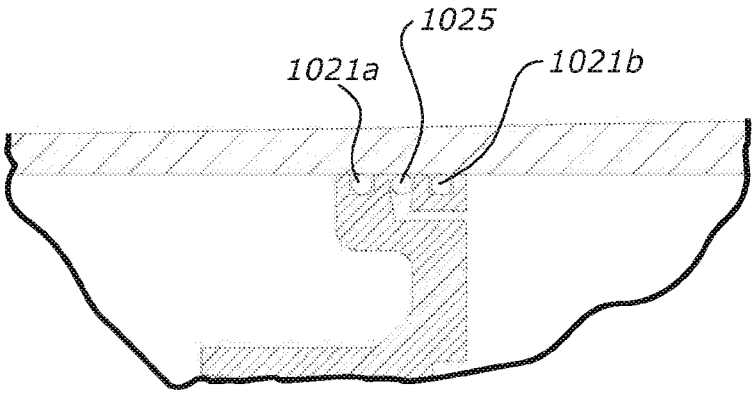
FIG. 10 is a section view of the mechanism of FIG. 9 showing detail 10 from FIG. 9.

FIG. 10 shows the expandable sealing member 1025 expanded in this position. While fluid can pass the expandable sealing member 1025, it is not able to pass the annular seal 1021*a*. That is, the sealing mechanism is in the sealing state, even though the expandable sealing member is expanded.

Figure 11:
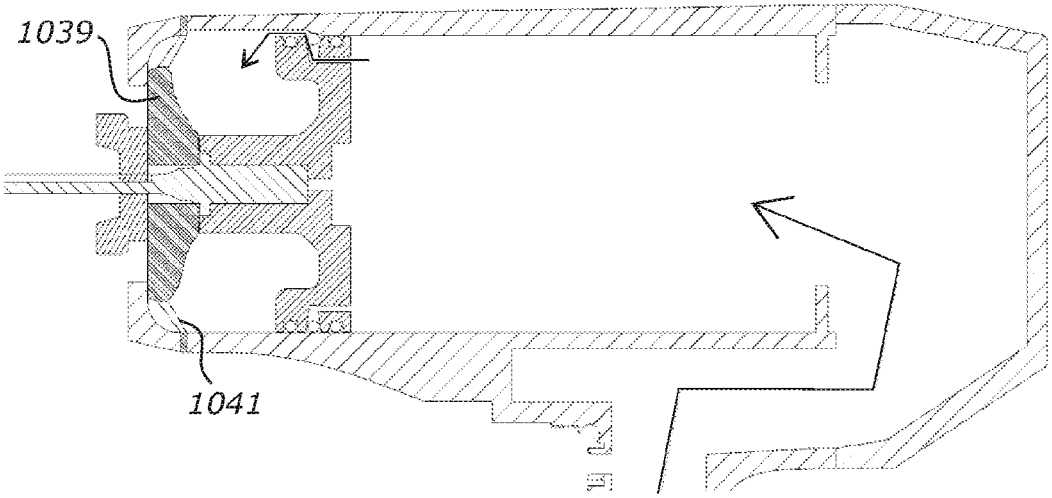
FIG. 11 is a section view of the mechanism of FIGS. 9 and 10 with the plunger in its second position with the expandable sealing member in an expanded state.

FIG. 11 shows the piston 1005 in the second position. In this position, the piston 1005 reaches the bumpstop 1039 and forces the bumpstop 1039 to seal the exhaust port(s) 1009. The front two seals on the piston are now sitting over the channels 1014. The pressurised air is now able to bypass the expandable sealing member 1025 and the annular seal 1021*a* and fill the front chamber 1017.

Figure 12:
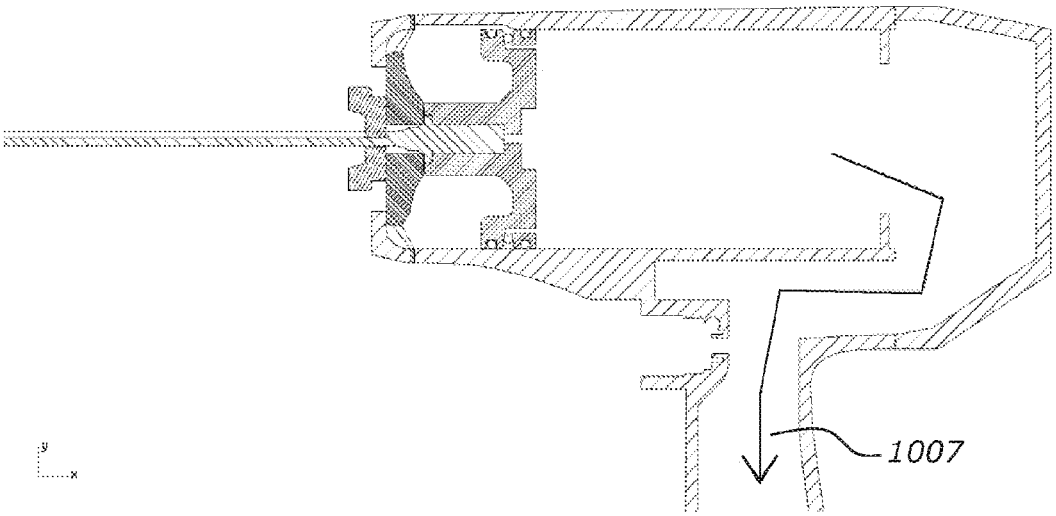
FIG. 12 is a section view of the mechanism of FIGS. 9 to 11 with the pressurised fluid being expelled from the rear chamber and the pressurised fluid in the front chamber causing the plunger to return to the first position.

FIG. 12 shows the pressurised air in the rear chamber vented to atmosphere. This causes a pressure imbalance with the pressurized air in the front chamber 1017. The imbalance forces the piston to move towards the first position.

The expandable sealing member 1025 remains sealed until the piston is fully retracted. The excess pressure is vented past the striker bar. The mechanism is now ready to fire again.

The mechanism 100 may be a pneumatic mechanism and the inlet port may be configured to receive compressed air. Alternatively the mechanism 100 may be a hydraulic mechanism wherein the inlet port may be configured to receive a hydraulic fluid.

The piston 5 may comprise a driving ram. The driving ram may be an elongate rod extending from the front of the piston 5. In an alternative embodiment, the piston 5 may comprise a driving ram protruding from both ends of the cylinder.

The piston 5 may move in a bore of a profile, in which over the entire length is made with a slot and provided with a sealing band. The piston 5 is connected through the slot, with a carriage. The sealing band passes through the piston so that the connection between the piston and the carriage is secured.

The piston chamber 3, may comprise one or more resilient stops at end(s) of the chamber for a soft arrest of movement of the piston 5 between its first and second positions. Alternatively, one or both surfaces of the piston 5 may comprise a resilient stop for a soft arrest of movement of the piston 5 between its first and second positions.

The housing 1 may comprise a guide channel for receiving and guiding the ram. The guide channel may comprise a bearing or seal surrounding the ram. The piston 5 may comprise a bearing such as an air bearing, or, a low friction strap.

The sealing mechanism has been described as having an expandable sealing member that expands and retracts between sealing and non-sealing states. In alternative embodiments, the sealing mechanism may have a sealing member that moves between different positions, orientations, and/or configurations between sealing and non-sealing states. For example, the sealing member may slide relative to the piston to move between the sealing and non-sealing states.

Embodiments of the invention have been described by way of example only and modifications may be made thereto without departing from the scope of the invention defined by the claims.

I claim:

1. A pneumatic or hydraulic mechanism comprising:

a housing defining a piston chamber and having a fluid inlet port and an exhaust port;

a piston slidable in the piston chamber, the piston partitioning the piston chamber into a front chamber and a rear chamber, the piston having one or more passages for fluid communication between the rear chamber and the front chamber, the one or more passages being sealed by a sealing mechanism;

the sealing mechanism having an expandable sealing member having a sealing state in which the expandable sealing member substantially inhibits fluid communication between the rear chamber and the front chamber, and a non-sealing state in which the expandable sealing member allows fluid communication between the rear chamber and the front chamber;

a movable bumpstop that is movable to seal the exhaust port;

the piston being slidable between a first position and a second position;

the piston chamber has a first portion corresponding to the first position of the piston and a second portion corresponding to the second position of the piston, wherein, when the piston is positioned in the first position, the expandable sealing member is in the sealing state in which the expandable sealing member is in direct contact with the interior surface of the piston chamber and is maintained in the sealing state by a wall of the first portion of the piston chamber, and fluid in front of the piston is exhausted from the exhaust port, past the movable bumpstop;

upon supply of a fluid to the inlet port, the fluid urges the piston to the second position at which the piston forces the bumpstop to seal the exhaust port, and the supply of the fluid then causes the expandable sealing member to change to the non-sealing state until the pressure in the rear chamber and the front chamber equalises, allowing the expandable sealing member to return to the sealing state, the expandable sealing member being allowed to change between the sealing state and the non-sealing state by the second portion of the piston chamber; and upon removal of fluid from the rear chamber, the fluid in the front chamber urges the piston to return to the first position.

2. The pneumatic or hydraulic mechanism of claim 1, wherein the first portion of the piston chamber has a first diameter and the second portion has a second diameter, the second diameter being larger than the first diameter.

3. The pneumatic or hydraulic mechanism of claim 1, wherein the second portion has a plurality of channels.

4. The pneumatic or hydraulic mechanism of claim 1, wherein the one or more passages comprises one or more bores.

5. The pneumatic or hydraulic mechanism of claim 1, wherein the expandable sealing member is an annular member.

6. The pneumatic or hydraulic mechanism of claim 1, further comprising one or more additional seals between the piston and the piston chamber.

7. The pneumatic or hydraulic mechanism of claim 1, further comprising one or more exhaust ports.

8. The pneumatic or hydraulic mechanism of claim 1, further comprising a piston rod.

* * * * *